US006358320B1

(12) United States Patent
Gottling

(10) Patent No.: US 6,358,320 B1
(45) Date of Patent: Mar. 19, 2002

(54) S-SHAPED GUN CARRIER FOR A POWDER COATING BOOTH

(76) Inventor: Manfred Gottling, Rheinstrasse 38, Solingen (DE), 42697

( * ) Notice: Subject to any disclaimer, the term of this patent is extended or adjusted under 35 U.S.C. 154(b) by 0 days.

(21) Appl. No.: 09/528,444

(22) Filed: Mar. 17, 2000

(30) Foreign Application Priority Data

Mar. 19, 1999 (DE) ..... 199 12 571

(51) Int. Cl.[7] ..... B05B 15/12; B05B 15/04; B05D 1/02

(52) U.S. Cl. ..... 118/326; 118/323

(58) Field of Search ..... 118/326, 301, 118/323, 309, 634, 312; 239/750; 248/75

(56) References Cited

U.S. PATENT DOCUMENTS 3,448,717 A 6/1969 Kuhlman 5,040,729 A 8/1991 Carrozza

FOREIGN PATENT DOCUMENTS

| | | |
|---|---|---|
| DE | 4131287 | 3/1993 |
| DE | 19500873 | 7/1996 |
| DE | 19722773 | 11/1998 |
| EP | 0037911 | 12/1981 |
| EP | 0349177 | 5/1990 |
| WO | 98/30336 | 7/1998 |

*Primary Examiner*—Richard Crispino
*Assistant Examiner*—Yewebdar T. Tadesse
(74) *Attorney, Agent, or Firm*—Diller, Ramik & Wight

(57) ABSTRACT

In order to optimize the coating process in a rotating powder coating booth and reduce the amount of overspray, it is proposed that the powder guns (9, 10) be mounted on a gun carrier (11, 12) which is designed as an S-shaped mounting arm and can be swung about a vertical axis (13, 14). The powder guns (9, 10) and the gun carriers (11, 12) can be moved in the vertical direction by means of a lifting device (17, 18).

11 Claims, 1 Drawing Sheet

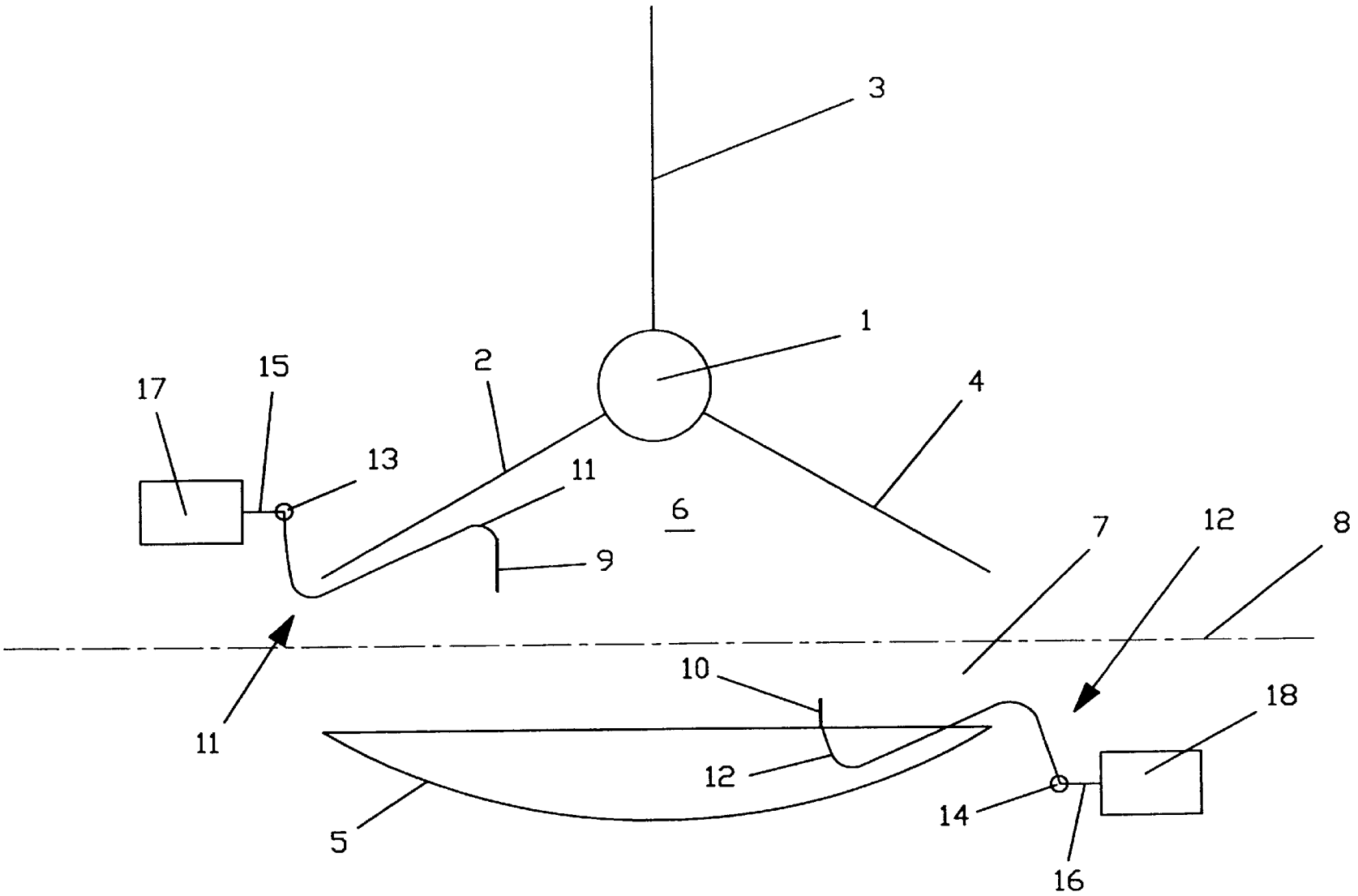
3
1
4
8
12
7
18
16
14
6
10
12
2
11
9
13
15
17
11
5

S-SHAPED GUN CARRIER FOR A POWDER COATING BOOTH

BACKGROUND OF THE INVENTION

The invention relates to a powder coating booth with at least one rotating booth wall carrier accommodating several wall elements forming at least two booth segments, where the booth wall carrier accommodates several side wall elements, extending in an approximately radial direction from an axis of rotation, and at least one mobile and/or sliding closing element designed in complementary fashion to the booth segments, said closing element forming an at least partially closed coating chamber in conjunction with one booth segment bordered by several wall elements, where at least the vertical edges of the side wall elements remote from the axis of rotation of the booth wall carrier are provided with cleaning elements, the closing element forms a concavely cylindrical inner booth wall and the closing element can be moved and/or slid in relation to the booth wall carrier in such a way that the edges of the side wall elements provided with cleaning elements pass over the inner wall of the closing element when the booth wall carrier is rotated, where moreover powder guns mounted on pivoting gun carriers are provided for feeding the coating powder into the coating booth.

A generic powder coating booth can be taken from DE 197 22 773 C1.

In this powder coating booth, the powder guns are mounted on straight gun carriers located on rotating gunstocks. By rotating the gunstocks, the powder guns can be swung through a gap into the coating chamber, so as to expose both sides of the parts to be coated to powder material.

With this kind of powder application, however, it is difficult to achieve optimum spacing between the powder gun and the parts to the coated, in addition to which, the amount of so-called overspray to be removed from the coating booth can be relatively high.

Consequently, the object of the invention is to improve a generic powder coating booth in such a way that powder application to the parts to be coated is optimised and the quantity of overspray generated is reduced.

SUMMARY OF THE INVENTION

According to the invention, the object is solved in that the gun carriers are designed as S-shaped mounting arms.

These special mounting arms now make it possible to swing the powder guns into the gap about a vertical axis located outside the powder coating booth in such a way that, inside the coating booth, they are located at an optimum distance and angle relative to the parts to be coated. As a result, the uniformity and thickness of powder application can be optimised, while simultaneously reducing the amount of overspray.

In the fixture according to the invention, several powder guns can be located alongside or above one another on the S-shaped mounting arm by means of corresponding gunstocks. Uniform, high-quality coating can, however, also be achieved with a single gun if the S-shaped mounting arm is connected to a lifting device located outside the coating booth, which raises and lowers the mounting arm, and thus the powder gun, in the vertical direction at a speed adapted to the production speed.

The coating thickness can be adjusted in simple fashion by varying the lifting speed of the lifting device, in combination with the throughput speed of the parts to be coated.

A further advantage of the S-shaped mounting arms for the powder guns is that the gap passed through by the transport device for the parts to be coated between the closing element and the star-shaped booth walls can be kept very small in working position, as the S-shaped bend of the mounting arm can be routed very tightly around the outer edges of the booth wall.

In the proposed configuration, cleaning of the arms or of the powder guns is very easily achieved due to the fact that the mounting arms can be swung out of the coating chamber and cleaned or replaced when the booth walls are in an appropriate position.

The joint for swinging the S-shaped mounting arms about a vertical axis is preferably located at the point where the mounting arms are connected to the lifting device.

BRIEF DESCRIPTION OF THE DRAWING

The FIGURE is a schematic top plan view of a powder coating booth, and illustrates a rotating booth wall carrier having multiple radially disposed wall elements that in cooperation with an arc-shaped booth wall form a partially enclosed coating chamber, multiple lifting devices, an S-shaped mounting arm attached to each lifting device so that the S-shaped mounting arm can extend into the coating chamber, and at least one powder gun disposed on the end of each S-shaped mounting arm that extends into the coating chamber.

DESCRIPTION OF THE PREFERRED EMBODIMENTS

The FIGURE shows a schematic illustration of three booth walls 2, 3 and 4, which are mounted in a star-shaped arrangement on a rotating booth wall carrier 1 and, together with an arc-shaped booth wall 5, also referred to as the closing element, form a coating chamber 6. Between the outer edges of booth walls 2 and 3 and closing element 5, there is a gap 7, through which a transport device 8 passes, carrying the parts to be coated (not shown).

Located at the inlet and outlet side on the inside of coating chamber 6 on either side of the parts to be coated are powder guns 9 and 10, which are each mounted on an S-shaped gun carrier or mounting arm 11, 12. Mounting arms 11 and 12 can be swung about vertical axes 13 and 14, and are borne by supporting arms 15 and 16 of lifting devices 17 and 18. The respective supporting arms of the lifting devices, and thus the gun carriers and powder guns, can be moved in the vertical direction.

What is claimed is:

1. A powder coating booth comprising a rotating booth wall carrier carrying a plurality of wall elements defining at least two booth segments, said rotating booth wall carrier having an axis of rotation, said plurality of wall elements being disposed radially with respect to said axis of rotation, means for at least partially closing each booth segment and defining therewith an at least partially closed coating chamber, means for movably supporting a powder gun for movement between respective first and second positions within and outside of said at least partially closed coating chamber, said powder gun being carried by a mounting arm at an end portion thereof remote from said movable supporting means, and said mounting arm being of a substantially S-shaped configuration.

2. The powder coating booth as defined in claim 1 wherein said movable supporting means is constructed and arranged for moving said powder gun in a vertical direction.

3. The powder coating booth as defined in claim 1 wherein said movable supporting means supports an adjacent end portion of said S-shaped mounting arm for pivotal movement about a vertical axis.

4. The powder coating booth as defined in claim 1 wherein said movable supporting means is constructed and arranged for moving said first S-shaped mounting arm between said first and second positions.

5. The powder coating booth as defined in claim 1 wherein said movable supporting means is constructed and arranged for moving said powder gun in a vertical direction, and said movable supporting means supports an adjacent end portion of said S-shaped mounting arm for pivotal movement about a vertical axis.

6. The powder coating booth as defined in claim 1 including a second powder gun, second means for movably supporting said second powder gun for movement between respective first and second positions within and outside of said at least partially closed coating chamber, said second powder gun being carried by a second mounting arm at an end portion thereof remote from said second movable supporting means, and said second mounting arm being of a substantially S-shaped configuration.

7. The powder coating booth as defined in claim 6 wherein said second movable supporting means is constructed and arranged for moving said second powder gun in a vertical direction.

8. The powder coating booth as defined in claim 6 wherein said second movable supporting means supports an adjacent end portion of said S-shaped second mounting arm for pivotal movement about a vertical axis.

9. The powder coating booth as defined in claim 6 wherein said second movable supporting means is constructed and arranged for moving said S-shaped second mounting arm between said first and second positions.

10. The powder coating booth as defined in claim 6 wherein said first-mentioned and second powder guns are arranged in a substantially opposing relationship.

11. The powder coating booth as defined in claim 6 wherein said second movable supporting means is constructed and arranged for moving said second powder gun in a vertical direction, and said second movable supporting means supports an adjacent end portion of said S-shaped second mounting arm for pivotal movement about a vertical axis.

* * * * *